United States Patent [19]

Putnam

[11] Patent Number: 5,022,586

[45] Date of Patent: Jun. 11, 1991

[54] GUTTER CLEANING DEVICE

[76] Inventor: William R. Putnam, 6701 SE. 74th, Portland, Oreg. 97206

[21] Appl. No.: 467,442

[22] Filed: Jan. 19, 1990

[51] Int. Cl.[5] ..... B08B 9/00; B05B 9/08

[52] U.S. Cl. ..... 239/71; 239/532; 134/167 C

[58] Field of Search ..... 239/71, 73, 532; 134/167 C, 172; 294/19.1; 15/236.04; 401/48, 137, 139, 261, 289

[56] References Cited

U.S. PATENT DOCUMENTS

| | | | |
|---|---|---|---|
| 2,896,239 | 7/1959 | Bugbird | 15/144 |
| 2,910,711 | 11/1959 | Mizelle | 239/532 |
| 3,041,655 | 7/1962 | Entler | 15/600 |
| 3,520,628 | 7/1970 | Moceri | 401/48 |
| 3,908,910 | 9/1975 | Detwiler | 239/532 |
| 4,013,225 | 3/1977 | Davis | 239/532 |
| 4,303,348 | 12/1981 | O'Brien | 401/137 |
| 4,304,498 | 12/1981 | George | 401/9 |
| 4,349,039 | 9/1982 | Egger | 134/167 C |
| 4,363,335 | 12/1982 | Tapper | 134/167 C |
| 4,750,883 | 6/1988 | Drake | 239/532 |
| 4,884,742 | 12/1989 | Bekius et al. | 239/71 |

*Primary Examiner*—Andres Kashnikow
*Assistant Examiner*—Karen B. Merritt
*Attorney, Agent, or Firm*—Henderson & Sturm

[57] ABSTRACT

A gutter cleaning device (10) including an adjustable handle unit (11) equipped with a shut off valve (70) operatively connected to a garden hose (100) and provided with an elongated nozzle member (50) having a shaft portion (51) and a spray head portion (52) with an elongated aperture (53) wherein the shaft portion (51) serves as an axle for an outer wheel member (40) and an inner hub member (41); wherein the hub member (41) serves as a rolling support for the device (10) and the wheel member (40) serves as a guide as the device (10) is moved along the gutter (101); and, wherein the shaft portion (51) is further provided with a nozzle adjustment disk (54) bearing indicia (55) representative of the orientation of the spray slot (53) in the spray head portion (52).

4 Claims, 1 Drawing Sheet

FIG. 1.
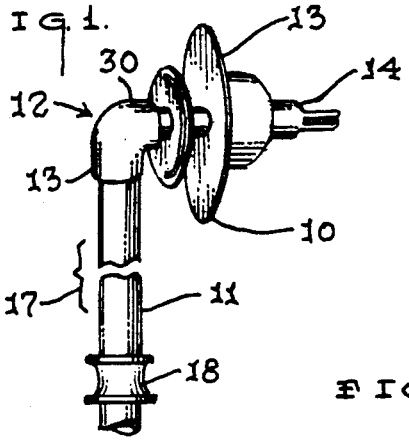
FIG. 2.
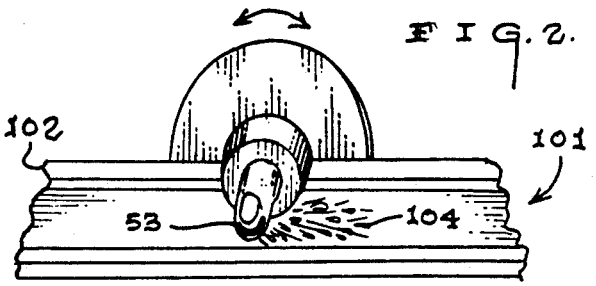
FIG. 5.
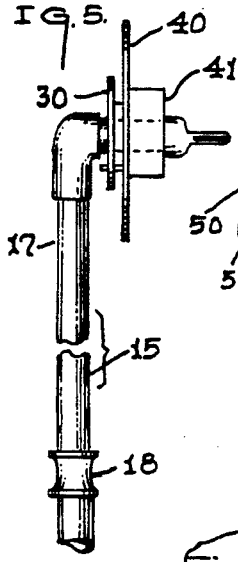
FIG. 6.
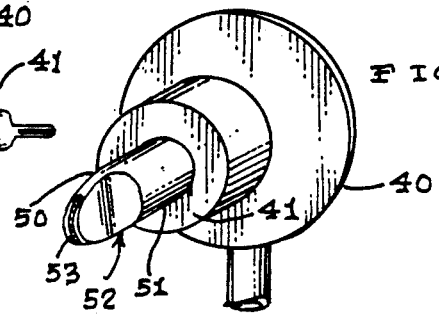
FIG. 4.
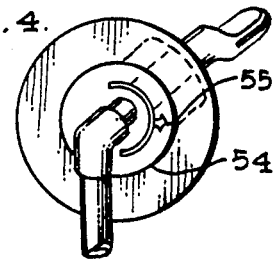
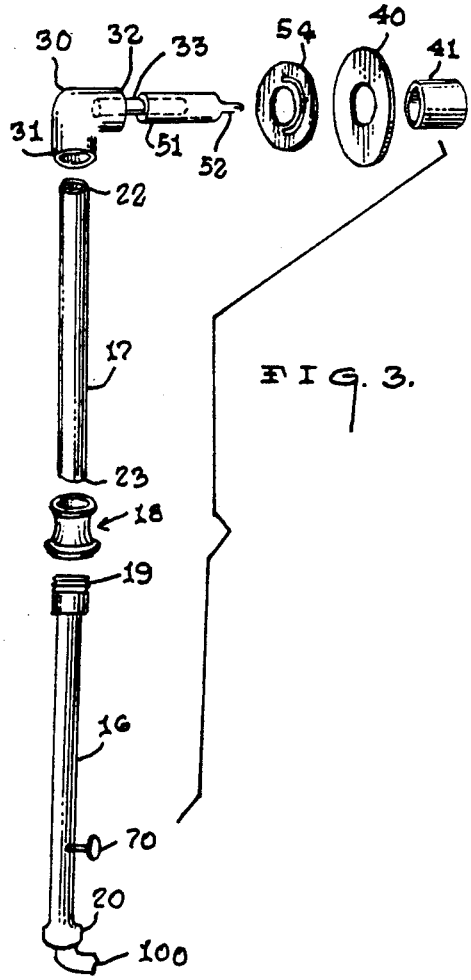
FIG. 3.
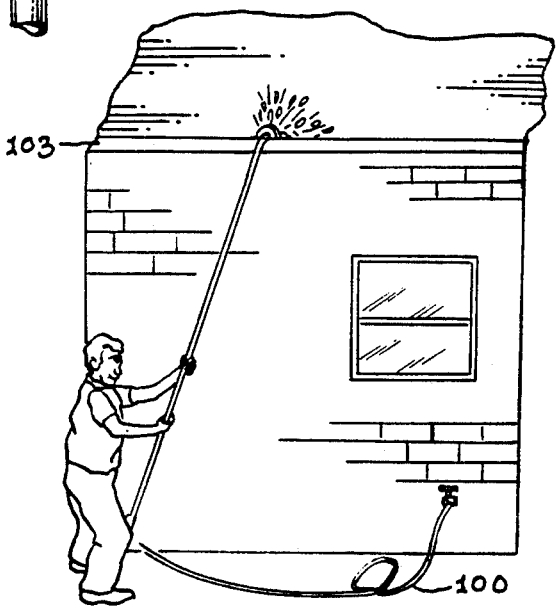
FIG. 7.

GUTTER CLEANING DEVICE

TECHNICAL FIELD

This invention relates to gutter cleaning devices in general, and more particularly to extendable water powered gutter cleaning devices which can be used to clean gutters without the aid of a ladder.

BACKGROUND OF THE INVENTION

As can be seen by reference to the following U.S. Pat. Nos.: 2,896,239; 4,303,348; 4,304,498; and 3,041,655 the prior art is replete with myriad and diverse gutter cleaners which are adapted to clean gutters from the ground without the use of a ladder.

While the prior art constructions are more than adequate for the basic purpose and function for which they were specifically designed, they do suffer from a number of shared deficiencies.

For instance, most of the prior art constructions lack the ability to travel the full length of the gutter without coming to a halt due to the presence of a gutter nail or some other obstacle within the gutter channel. Once the user encounters such an obstruction the user must manually lift the device over the obstruction to continue the cleaning process. This particular design deficiency creates an inefficient and cumbersome way to clean gutters.

In addition, another common shortcoming in the prior art construction is that the user has to hold the gutter cleaning device in place and exert effort to move the device along the gutter. This drawback makes the task of cleaning a gutter a tiresome chore.

Furthermore, most of the prior art constructions do not provide the feature of being able to rotate the nozzle 180° for different directional use. This shortcoming makes cleaning the gutter much more difficult than necessary and if the nozzle cannot be turned directly downward it is virtually impossible to clean a downspout.

Furthermore, none of the prior art devices incorporate readily visible indicia on the nozzle element to allow the user on the ground to know the exact angle of orientation of the nozzle outlet relative to the gutter as the device traverses the length of the gutter.

Obviously there has existed a long standing need for a gutter cleaning device which addresses all of the above stated deficiencies of the prior art constructions; and, the development of such a device is the stated purpose and objective of the present invention.

In addition, in as much as insurance statistics indicate that the most frequent accidents which occur around the home while employing a ladder involve the act of cleaning a gutter, the subject matter of this invention should go a long way towards reducing that unfortunate statistic, since a ladder is not required with this invention.

BRIEF SUMMARY OF THE INVENTION

An object of the present invention is to provide a water powered gutter cleaning device for removing debris from a gutter by an operator positioned from a remote location relative to the gutter.

Another object of the present invention is to provide a gutter cleaning device that has an adjustable handle unit so that the device has the ability to clean different height roofs.

Still another object of the present invention is to provide a gutter cleaning device which has the ability to travel the full length of the gutter without being stopped by obstructions in the gutter.

A further object of the present invention is to provide a gutter cleaning device which is specifically designed to rest on the edge of the gutter unaided, requiring no outside force to hold it in place.

Yet another object of the present invention is for the nozzle of the gutter cleaner to have 180° of movement for spraying purposes.

A yet further object of the present invention is to provide indicia on the gutter cleaning device to let the operator of the device know at exactly what angle the nozzle of the device is pointing relative to the gutter interior.

BRIEF DESCRIPTION OF THE DRAWINGS

These and other objects, advantages and novel features of the invention will become apparent from the detailed description of the best mode for carrying out the preferred embodiment of the invention which follows; particularly when considered in conjunction with the accompanying drawings, wherein:

FIG. 1 is a perspective view of the device;

FIG. 2 is a front view of the device in use;

FIG. 3 is an exploded perspective view of the device;

FIG. 4 is a rear perspective view of the upper portion of the device;

FIG. 5 is a side plan view of the upper portion of the device;

FIG. 6 is a front perspective view of the upper portion of the device; and,

FIG. 7 is a detail view of the device in use.

BEST MODE FOR CARRYING OUT THE INVENTION

As can best be seen by reference to the drawings and in particular to FIG. 1, the gutter cleaner device of this invention is designated generally by the reference numeral (10). The device comprises in general: an adjustable handle unit (11); an elbow unit (12); a wheel unit (13); and, a nozzle unit (14). These units will now be described in seriatim fashion.

As can be seen by reference to FIG. 3, the handle unit (11) comprises in general: an elongated hollow shaft member (15) consisting of two separate portions which include an enlarged diameter elongated hollow cylindrical female member (16) and a reduced diameter elongated hollow cylindrical male member (17); wherein these two portions are joined together by a releasable internally threaded locking collar member (18).

Still referring to FIG. 3, the enlarged diameter elongated hollow cylindrical female member (16) comprises a split and threaded upper end portion (19) which is adapted to receive the locking member (18) and an enlarged lower end portion (20) designed to receive the male end of a standard garden hose (100).

Still referring to FIG. 3, the male member (17) comprises an upper male portion (22) which is inserted into the elbow unit (12) and a lower male portion (23) which is inserted into the female member (16); wherein, the locking collar member (18) can be moved from the upper male portion (22) to the lower male portion (23) to produce the desired height setting.

The particular height of the handle unit (11) is determined by how far the male member (17) is inserted into the female member (16). The male member (17) is locked in place with the female member (16) by rotating the locking collar member (18) around the threaded upper portion of the female member (16). This disposition of the locking collar member (18) on the split and threaded upper end portion (19) of the female member (16) causes the female member (16) to contract and firmly grasp the male member (17) in a well recognized fashion, thereby making the hollow shaft member (15) act like a single shaft.

Still referring to FIG. 3, the elbow unit (12) comprises in general: a hollow enlarged diameter right angle elbow connecting member (30) having a handle insertion portion (31) and a nozzle insertion portion (32). The handle insertion portion (31) receives the upper male portion (22) of the reduced diameter male member (17). In addition, the size differential between the handle insertion portion (31) and the upper male portion (22) is chosen to produce a snug fit between these respective structural components while the nozzle insertion portion is dimensioned to receive a nozzle support tube (33) which will rotatably support the nozzle unit (14).

Referring now to FIGS. 2 and 6, it can be seen that the wheel unit (13) comprises in general: a large diameter outer wheel member (40) and a smaller diameter inner cylindrical hub member (41). The large diameter outside wheel member (40) is intended to be suspended from the small diameter inside hub member (41) when the hub member (41) rests on the lip (102) of the gutter (101) and to keep the gutter device (10) in correct alignment relative to the outer wall (103) of the gutter (101). The smaller diameter inside cylindrical member (41) rests on the top lip (102) of the gutter (101) and is used to guide the device along the gutter (101).

As can best be seen by reference to FIG. 3, the nozzle unit (14) comprises a reduced diameter generally elongated cylindrical nozzle member (50) which comprises a shaft portion (51) rotatably received by the nozzle support tube (33) of the elbow unit (12) and a spray head portion (52). The cylindrical nozzle member (50) acts as an axle for the wheel unit (13).

The spray head portion (52) of the nozzle member (50) is provided with an elongated slot (53) which produces a fan spray to accomplish the spraying of the water (104) on the inside of the gutter (101) to loosen and wash away debris. The elongated slot (53) also produces an accelerated spray due to the increase in pressure in the nozzle member (50). In addition, the nozzle member (50) can be rotated to produce a desired spraying angle.

As can be seen in particular by reference to FIG. 4, the shaft portion (51) of the nozzle member (50) is further provided with a nozzle angle adjustment disk (54) which is fixedly secured to the periphery of the shaft portion (51); and, bears indicia in the form of an arrow (55) which is aligned with the orientation of the spray slot (53) in the spray head portion (52). In this manner the operator on the ground can immediately determine the orientation of the nozzle member (50) relative to the interior of the gutter (101) and adjust the nozzle member (50) accordingly if necessary.

Having thereby described the subject matter of this invention it should be apparent that many substitutions, modifications, and variations of the invention are possible in light of the above teachings. It is therefore to be understood that the invention as taught and described herein is only to be limited by the breadth and scope of the appended claims.

I claim:

1. A gutter cleaning device adapted to be connected to a conventional garden hose to flush debris from a gutter wherein the device comprises:

an adjustable handle unit operatively secured on the lower end to said conventional garden hose and having an upper end;

an elbow unit operatively secured to the upper end of the adjustable handle unit and comprising an elbow connection member having: a handle insertion portion on one end which is dimensioned to frictionally engage the upper end of the handle unit; and, a nozzle support tube on the other end;

a nozzle unit comprising a generally elongated nozzle member including a shaft portion dimensioned to be rotatably disposed on said nozzle support tube of the elbow unit; and, a spray head portion formed on the free end of the nozzle member; and, a wheel unit comprising a large diameter outer wheel member and smaller diameter inner cylindrical hub member wherein the outer wheel member serves as a guide as the device rolls along the side of the gutter, and the hub member supports the device as the hub member traverses the top of the gutter; wherein, the wheel member and the hub member are operatively and rotatably disposed on said elongated nozzle member.

2. The device as in claim 1 further comprising an indicator disk fixedly secured to the shaft portion of the nozzle member.

3. The device as in claim 2 wherein the spray head portion of the nozzle member is provided with an elongated spray slot.

4. The device as in claim 3 wherein the indicator disk is provided with indicia in the form of an arrow; wherein the arrow is aligned with the orientation of the said spray slot.

* * * * *